US009356727B2

(12) United States Patent
Immendorf et al.

(10) Patent No.: US 9,356,727 B2
(45) Date of Patent: May 31, 2016

(54) METHOD AND SYSTEM FOR INTELLIGENT JAMMING SIGNAL GENERATION

(71) Applicant: Eden Rock Communications, LLC, Bothell, WA (US)

(72) Inventors: Chaz Immendorf, Bothell, WA (US); Jungnam Yun, Bothell, WA (US); Eamonn Gormley, Bothell, WA (US)

(73) Assignee: Spectrum Effect Inc., Seattle, WA (US)

( * ) Notice: Subject to any disclaimer, the term of this patent is extended or adjusted under 35 U.S.C. 154(b) by 118 days.

(21) Appl. No.: 14/142,715

(22) Filed: Dec. 27, 2013

(65) Prior Publication Data

US 2014/0206279 A1 Jul. 24, 2014

Related U.S. Application Data

(60) Provisional application No. 61/755,432, filed on Jan. 22, 2013.

(51) Int. Cl.
*H04K 3/00* (2006.01)

(52) U.S. Cl.
CPC .. *H04K 3/40* (2013.01); *H04K 3/41* (2013.01); *H04K 3/42* (2013.01); *H04K 3/45* (2013.01); *H04K 2203/16* (2013.01); *H04K 2203/34* (2013.01)

(58) Field of Classification Search
CPC ..... H04K 3/40; H04K 3/00; H04K 3/20; H04K 3/22; H04K 3/222; H04K 3/224; H04K 3/228; H04K 3/28; H04K 3/60; H04K 3/80; H04K 2203/00; H04K 2203/10
USPC ..... 455/1, 63, 67.1, 54.1, 404.1, 422.1, 455/456.5, 561, 431, 73, 430; 342/14; 704/246; 375/285
See application file for complete search history.

(56) References Cited

U.S. PATENT DOCUMENTS 5,850,596 A * 12/1998 Reynolds ..... 455/63.1
8,301,075 B2 * 10/2012 Sherman ..... H04B 1/1036 340/539.1
8,543,053 B1 * 9/2013 Melamed ..... H04K 3/43 455/1
9,088,903 B2 * 7/2015 Kim ..... H04L 45/22
9,246,629 B2 * 1/2016 Coleman ..... H04K 3/42
2003/0054755 A1 * 3/2003 Zehavi ..... H04K 3/228 455/1
2004/0154460 A1 * 8/2004 Virolainen et al. ..... 84/645
2004/0242149 A1 12/2004 Luneau
2005/0181823 A1 * 8/2005 Haartsen ..... H04W 16/14 455/553.1
2007/0087763 A1 * 4/2007 Budampati et al. ..... 455/456.5
2007/0291866 A1 * 12/2007 Rajappan ..... H04B 7/0413 375/267
2008/0096518 A1 * 4/2008 Mock et al. ..... 455/404.1

(Continued)

OTHER PUBLICATIONS

International Search Report and Written Opinion for PCT/US2013/078136, filed Dec. 27, 2013.

*Primary Examiner* — Tan H Trinh

(57) ABSTRACT

Detecting and jamming a wireless network using an intelligent jammer comprises determining that a signal source is an unlicensed signal source, synchronizing the intelligent jammer with the unlicensed signal source, determining a time and a frequency of a protocol signal associated with the unlicensed signal source, and transmitting a jamming signal according to the time and the frequency of the protocol signal. A system for detecting and jamming a wireless network comprises a first intelligent jammer, and an Intelligent Detection and Jamming Server (IDJS) coupled to the first intelligent jammer.

20 Claims, 8 Drawing Sheets

(56) References Cited

U.S. PATENT DOCUMENTS

2008/0119130 A1 5/2008 Sinha
2008/0174470 A1* 7/2008 Lum ..... H04B 7/0845 342/16
2009/0237289 A1* 9/2009 Stoddard ..... H04K 3/28 342/14
2010/0040178 A1* 2/2010 Sutton ..... H04B 7/0845 375/345
2010/0062705 A1* 3/2010 Rajkotia et al. ..... 455/1
2010/0240315 A1 9/2010 Tufvesson et al.
2010/0302087 A1* 12/2010 Low ..... 342/14
2011/0086590 A1 4/2011 Johnson et al.
2011/0183602 A1* 7/2011 Tietz ..... H04K 3/45 455/1
2011/0223851 A1* 9/2011 Stoddard ..... H04K 3/28 455/1
2012/0052793 A1* 3/2012 Brisebois et al. ..... 455/1
2014/0122074 A1* 5/2014 Karmarkar et al. ..... 704/246
2014/0204766 A1* 7/2014 Immendorf ..... H04W 24/04 370/242

* cited by examiner

METHOD AND SYSTEM FOR INTELLIGENT JAMMING SIGNAL GENERATION

CROSS-REFERENCES TO RELATED APPLICATIONS

The present invention claims priority to U.S. Provisional Application No. 61/755,432, filed Jan. 22, 2013, which is herein incorporated by reference for all purposes.

BACKGROUND OF THE INVENTION

Wireless spectrum is a limited resource that wireless network operators typically acquire a license to use. The fees for a wireless spectrum license permitting the use of one or more frequency bands within a geographic area can be high.

However, some wireless network operators operate without obtaining a license, often in frequency bands and areas for which such a license is required by law. This unlicensed use of wireless spectrum may interfere with the licensed use of wireless spectrum.

Another potential source of interference with the use of wireless spectrum is jamming. Jamming refers to the transmission of signals adapted to prevent or degrade communications. Both licensed and unlicensed uses of wireless spectrum may be susceptible to jamming

BRIEF SUMMARY OF THE INVENTION

Embodiments of the present disclosure include systems and methods for detecting and jamming a wireless network using one or more intelligent jammers.

An embodiment of a method for detecting and jamming a wireless network using an intelligent jammer comprises determining that a signal source is an unlicensed signal source, synchronizing the intelligent jammer with the unlicensed signal source, determining a time and a frequency of a protocol signal associated with the unlicensed signal source, and transmitting a jamming signal according to the time and the frequency of the protocol signal.

In an embodiment, determining that the signal source is the unlicensed signal source comprises receiving a signal from the signal source and performing an authentication protocol with the unlicensed signal source, wherein the authentication protocol fails.

In an embodiment, determining that the signal source is the unlicensed signal source comprises determining a characteristic of a received signal from the signal source (the characteristic including one or more of a location, a frequency, or an identifier), determining whether the characteristic of the received signal is in a predetermined database, and when the characteristic of the received signal is not in the database, classifying the signal source as the unlicensed signal source.

In an embodiment, determining that the signal source is the unlicensed signal source further comprises when the characteristic of the received signal is in the database and the characteristic is not associated with a licensed signal source, classifying the signal source as the unlicensed signal source. In an embodiment, the characteristic includes a channel center frequency or a channel bandwidth. In an embodiment, the identifier includes a Public Land Mobile Network ID (PLMN ID), a Mobile Country Code (MCC), a Mobile Network Code (MNC), a Tracking Area Code (TAC), or an E-UTRAN Cell Global ID (ECGI).

In an embodiment, transmitting the jamming signal comprises detecting a change in the time or the frequency of the protocol signal, and transmitting the jamming signal according to the change in the time or the frequency of the protocol signal.

In an embodiment, the unlicensed signal source is a cellular radio base station.

In an embodiment, transmitting the jamming signal comprises transmitting an uplink (UL) jamming signal. The UL jamming signal includes one or more of a Physical Random Access Channel (PRACH) noise signal, a bogus PRACH preamble signal, or an edge noise signal.

In an embodiment, transmitting the jamming signal comprises transmitting a downlink (DL) jamming signal. The DL jamming signal includes one or more of a downlink channel center (DLCC) noise signal, a bogus Primary Synchronization Signal (PSS), a bogus Secondary Synchronization Signal (SSS), or a bogus Broadcast Channel (BCH) signal.

In an embodiment, transmitting the jamming signal comprises transmitting the bogus PSS or the bogus SSS in a subframe of an LTE frame other than a first subframe and a sixth subframe, transmitting the bogus BCH signal in a subframe of the LTE frame other than a first subframe, or a combination thereof.

In an embodiment, the method further comprises determining a time and a frequency of an expected transmission to or from the unlicensed signal source, and transmitting the jamming signal at a time and a frequency corresponding to the time and a frequency of the expected transmission to or from the unlicensed signal source.

In an embodiment, transmitting the jamming signal according to the time and frequency of the protocol signal comprises selecting the intelligent jammer from a plurality of intelligent jammers according to an RF path loss associated with the intelligent jammer, and transmitting the jamming signal using the intelligent jammer.

In an embodiment, the intelligent jammer is a first intelligent jammer, and transmitting the jamming signal comprises selecting the first intelligent jammer from a plurality of intelligent jammers, selecting a second intelligent jammer from the plurality of intelligent jammers, transmitting a downlink (DL) jamming signal using the first intelligent jammer, and transmitting an uplink (UL) jamming signal using the second intelligent jammer.

An embodiment of a system for detecting and jamming a wireless network comprises a first intelligent jammer, and an Intelligent Detection and Jamming Server (IDJS) coupled to the first intelligent jammer. The IDJS including a processor and a non-transitory computer readable medium with computer executable instructions stored thereon which, when executed by the processor, perform the following steps: receiving first information associated with a signal source from the first intelligent jammer, determining that a signal source is an unlicensed signal source using the first information, and transmitting a first instruction to jam the unlicensed signal source to the first intelligent jammer.

In an embodiment, the system further comprising a wireless device, and the steps performed further include receiving second information associated with the signal source from the wireless device, and determining that a signal source is an unlicensed signal source uses the first information and the second information.

In an embodiment, the steps performed further include transmitting a second instruction to jam the unlicensed signal source to a second intelligent jammer.

In an embodiment, one of the first and second instructions includes an instruction to jam only an uplink channel, and the other of the first and second instructions includes an instruction to jam only a downlink channel.

In an embodiment, the first instruction includes an instruction to transmit a jamming signal only at a time and a frequency when a communication to or from the unlicensed signal source is expected to occur.

In an embodiment, the first instruction includes an instruction to periodically vary a frequency of a jamming signal, a timing of a jamming signal, symbols of a jamming signal, or a combination thereof.

In an embodiment, the first instruction includes an instruction to jam one or more protocol signals associated with the unlicensed signal source.

An embodiment of a system for detecting and jamming a wireless network comprises an Intelligent Detection and Jamming Server (IDJS), and an intelligent jammer coupled to the IDJS. The intelligent jammer including a transmitter, a receiver, a processor and a non-transitory computer readable medium with computer executable instructions stored thereon which, when executed by the processor, perform the following steps: receiving a signal from a signal source, determining information associated with the signal source using the signal, transmitting the information associated with the signal source, receiving an instruction, and when the instruction includes an instruction to jam the signal source, generating and transmitting a jamming signal using the information associated with the signal source and information included in the instruction.

In an embodiment, performing the steps further includes generating and transmitting the jamming signal only jamming an uplink channel, or generating and transmitting the jamming signal only jamming an downlink channel.

In an embodiment, performing the steps further includes generating and transmitting the jamming signal only at a time and a frequency when a communication to or from the unlicensed signal source is expected to occur.

In an embodiment, performing the steps further includes periodically varying a frequency of the jamming signal, a timing of the jamming signal, a symbol of the jamming signal, or a combination thereof.

In an embodiment, the jamming signal jams one or more protocol signals associated with the unlicensed signal source.

DETAILED DESCRIPTION OF THE INVENTION

Figure 1:
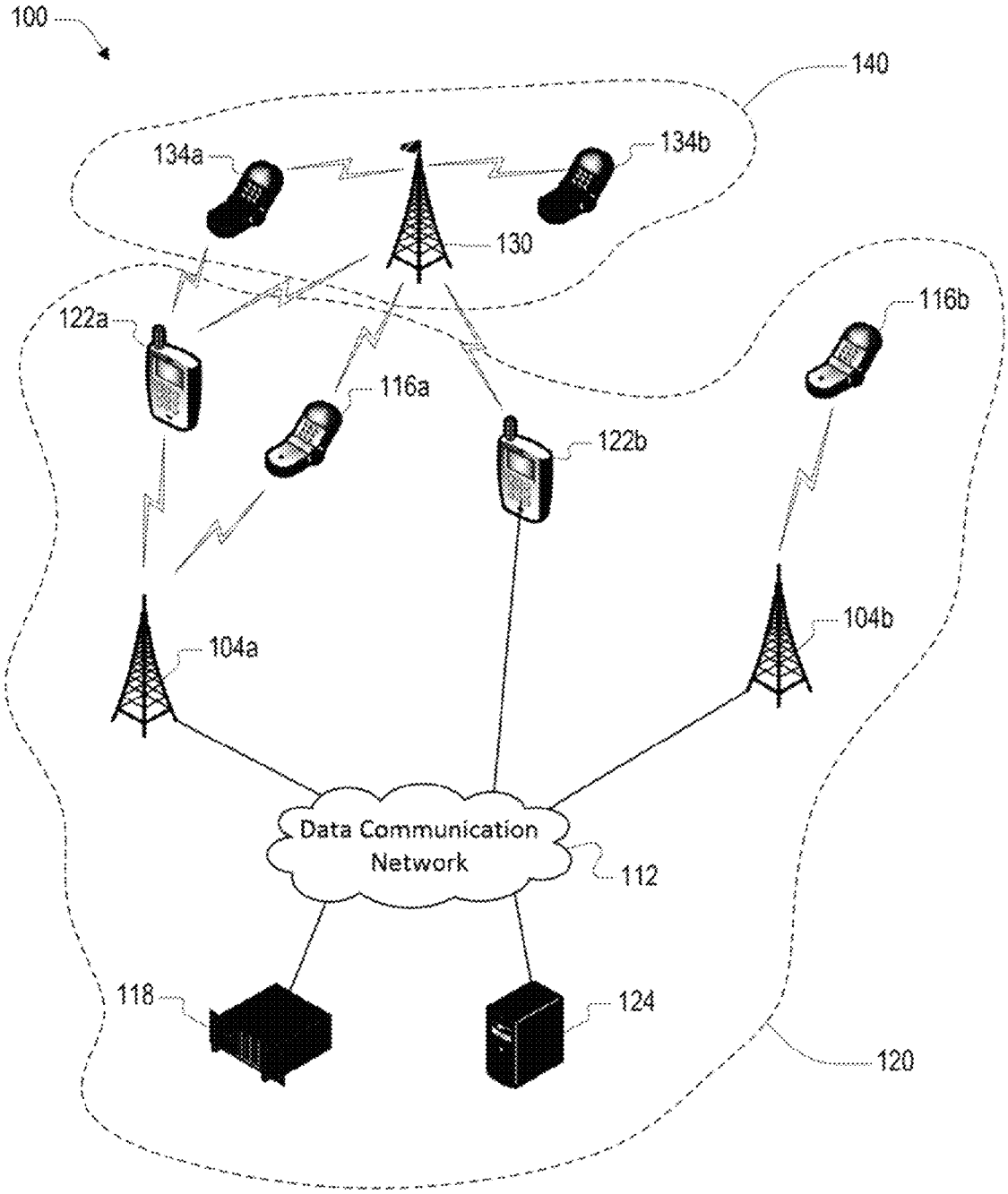
FIG. 1 depicts an intelligent jamming system according to an embodiment.

In the following detailed description, reference is made to the accompanying drawings, which form a part of the description. The example embodiments described in the detailed description, drawings, and claims are not meant to be limiting. Other embodiments may be utilized, and other changes may be made, without departing from the spirit or scope of the subject matter presented herein. It will be understood that the aspects of the present disclosure, as generally described herein and illustrated in the drawings, may be arranged, substituted, combined, separated, and designed in a wide variety of different configurations.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of embodiments is provided below along with accompanying figures that illustrate the principles of the invention. The invention is described in connection with such embodiments, but the invention is not limited to any embodiment. The scope of the invention is limited only by the claims and the invention encompasses numerous alternatives, modifications, and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system, apparatus, and method according to embodiments of the present invention may implement various aspects of intelligently detecting and jamming a wireless device in a wireless communications network. The aspects may include detecting the operation of the wireless device, determining whether to jam the wireless device, and generating signals that prevent or degrade communication with the wireless device.

The following description includes examples of how various aspects of the present invention may be implemented. Although the example primarily discusses the invention in the context of a wireless communication system employing Long Term Evolution (LTE) technology, a person of skill of the art in light of the teachings and disclosures herein would understand that embodiments of the invention could operate with other wireless technologies, including cellular radio technologies such as Global System for Mobile communications (GSM), Universal Mobile Telecommunication System (UMTS), Wi-Fi®, and WiMax™.

FIG. 1 illustrates a wireless network environment 100 including several base stations using a licensable portion of the wireless spectrum according to an embodiment. The base stations include a first licensed Evolved Node B (eNodeB) 104*a* and a second licensed eNodeB 104*b*. The licensed eNodeBs 104*a-b* are cellular radio base stations and may be used with macrocells, microcells, picocells, and femtocells. The licensed eNodeBs 104*a-b* use a licensable portion of the wireless spectrum under a license.

The licensed eNodeBs 104 provide wireless communication services to a first User Equipment (UE) 116*a* and a second UE 116*b*. Wireless communication services include voice services and/or data services.

The licensed eNodeBs 104 are connected to a data communication network 112. The data communication network 112 provides communication services that allow the licensed eNodeBs 104*a-b* to communicate with any of each other and with wireless network control server 118. The data communication network 112 includes wired and/or wireless communication links. The data communications network 112 may include a backhaul portion. The data communication network 112 may include switches, routers, gateways, firewalls, and/or other networking equipment. In an embodiment, the data communication network 112 is coupled to the Internet.

The licensed eNodeBs 104*a-b*, data communication network 112, wireless network controller 118, and UEs 116*a-b* operate together to form a licensed wireless system 120. The wireless network controller 118 operates to manage and control the operation of the components of the licensed wireless system 120. In an embodiment, the wireless network controller 118 is associated with an eNodeB.

Within the licensed wireless system 120, signals are transmitted from the licensed eNodeBs 104*a-b* and received by the UEs 116*a-b* using downlink (DL) channels, and signals are transmitted from the UEs 116*a-c* and received by the licensed eNodeBs 104*a-b* using uplink (UL) channels.

The base stations shown in FIG. 1 also include unlicensed eNodeB 130. The unlicensed eNodeB 130 is an unlicensed signal source that uses a licensable portion of the wireless spectrum without being licensed to do so. The unlicensed eNodeB 130 is a cellular radio base station and may be used with macrocells, microcells, picocells, and femtocells.

The unlicensed eNodeB 130 provides wireless communication services to a third UE 134*a* and a fourth UE 134*b*. The unlicensed eNodeB 130 and the UE 134*a-b* operate together to form an unlicensed wireless system 140. The unlicensed wireless system 140 may operate in a same geographical area as the licensed wireless system 120, or in an isolated geographic area outside of the geographic areas covered by the licensed wireless system 120.

The operation of the unlicensed wireless system 140 may interfere with the ability of licensing authorities to allocate wireless spectrum among competing users and to generate revenue. In addition, the operation of the unlicensed wireless system 140 may allow a security breach (such as a man-in-the-middle attack) if one or more of the UEs 116 unwittingly connects to the unlicensed wireless system 140.

Furthermore, if a portion of the unlicensed wireless system 140 operates in a same area as a portion of the licensed wireless system 120, the unlicensed wireless system 140 may degrade or prevent the operation of the licensed wireless system 120 within the same area. For example, if signals from both the licensed eNodeB 104*a* and the unlicensed eNodeB 130 reach the first UE 116*a*, the signals from the unlicensed eNodeB 130 may interfere with or prevent the reception by the first UE 116*a* of the signals from the licensed eNodeB 104*a*. The same area may be a geographic area. In an embodiment, the geographic area is an area within a structure.

First intelligent jammers 122*a* and second intelligent jammer 122*b* are deployed in wireless network environment 100 and are able to detect, identify, and degrade or disable the operation of the unlicensed eNodeB 130.

The intelligent jammers 122*a-b* are able to degrade or disable the operation of the unlicensed eNodeB 130 by jamming the unlicensed eNodeB 130, that is, by transmitting jamming signals that interfere with communications between the unlicensed eNodeB 130 and the UEs 134*a-b*. The jamming signals can interfere with DL communications from the unlicensed eNodeB 130 and/or interfere with UL communications from the UEs 134*a-b*.

The first intelligent jammer 122*a* is within range of the first licensed eNodeB 104*a* and accordingly can communicate wirelessly with the data communication network 112 using the first licensed eNodeB 104*a*. The second intelligent jammer 122*b* can communicate with the data communication network 112 using a wired communication link such as, for example, a connection provided by an Internet Service Provider (ISP). As a result, both of the intelligent jammers 122*a-b* can communicate with other elements of licensed wireless system 120, including an Intelligent Detection and Jamming Server (IDJS) 124 connected to the licensed wireless system 120.

The IDJS 124 is shown connected to the wireless system 120 using a wired communication link to data communication network 112. Alternatively, the IDJS 124 may connect to the licensed wireless system 120 wirelessly, such as by using a wireless communication link to one or more licensed eNodeBs 104.

In an embodiment, any of the IDJS 124, the wireless network controller 118, the licensed eNodeBs 104*a-b*, the intelligent jammers 122*a-b*, as well as any of the UEs 116*a-b* may be configured to run any well-known operating system, including, but not limited to: Microsoft® Windows®, Mac OS®, Google® Chrome®, Linux®, Unix®, or any mobile operating system, including Symbian®, Palm®, Windows Mobile®, Google® Android®, Mobile Linux®, etc. Any of the IDJS 124, the wireless network controller 118, the eNodeBs 104*a-b*, and the intelligent jammers 122*a-b* may employ any number of common server, desktop, laptop, and personal computing devices.

In an embodiment, any of the UEs 116*a-b* or UEs 134*a-b* may be associated with any combination of common mobile computing devices (e.g., laptop computers, tablet computers, desktop computers, wireless hotspot devices, wireless modems, cellular phones, handheld gaming units, electronic book devices, personal music players, MiFi™ devices, video recorders, etc.), having wireless communications capabilities employing any common wireless data communications technology, including, but not limited to: GSM, UMTS, 3GPP LTE™, LTE™ Advanced, WiMAX™, etc. The UEs 116*a-b* or UEs 134*a-b* are wireless devices.

In an embodiment, the wireless network controller 118 includes the IDJS 124.

The IJDS 124 and the intelligent jammers 122*a-b* together with the communication resources provided to them by the licensed wireless system 120 form an intelligent jamming system. The intelligent jamming system may further include any or all of the licensed eNodeBs 104*a-b*, the UEs 116*a-b*, and the wireless network controller 118. In an embodiment, elements of the IJDS 124 are included in the licensed eNodeBs 104*a-b*.

Figure 2:
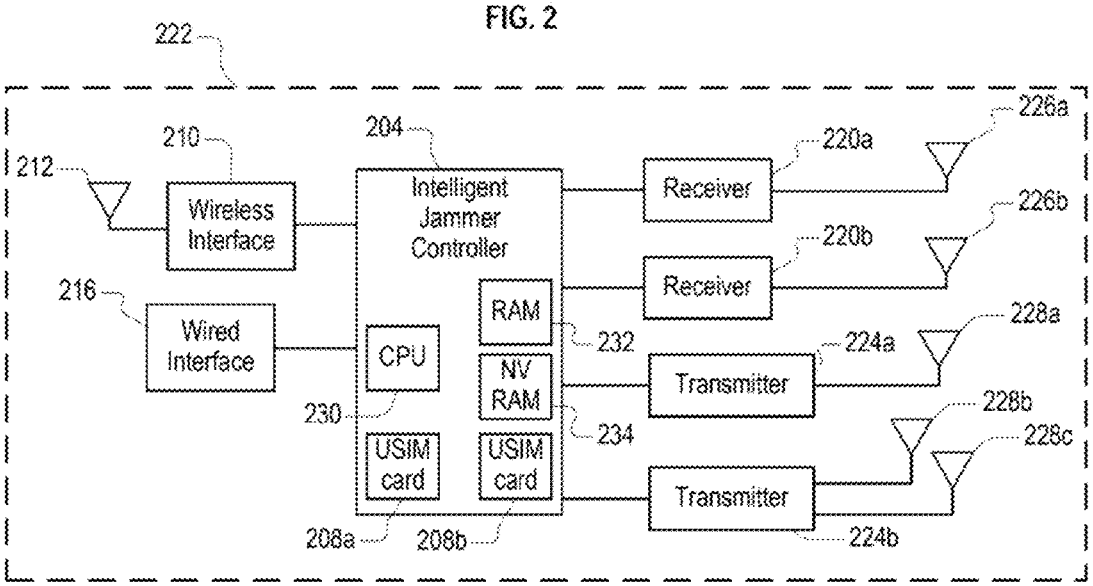
FIG. 2 is a block diagram of an intelligent jammer according to an embodiment.

FIG. 2 illustrates a block diagram of an intelligent jammer 222 according to an embodiment of the disclosure that may represent any of the intelligent jammers 122*a-b* shown in FIG. 1. An embodiment of the intelligent jammer 222 may be portable and carried by hand or in a backpack, or may be attached to or incorporated into an automobile, boat, aircraft, tethered balloon, remotely-piloted Unmanned Aerial Vehicle (UAV), or autonomous UAV. In an embodiment, the intelligent jammer 222 may be transported through a geographic area in order to search for unlicensed wireless devices.

The intelligent jammer 222 includes an intelligent jammer controller 204, wireless interfaces 210, wired interface 214, first and second receivers 220*a* and 220*b*, first and second transmitters 224*a* and 224*b*, communication antenna 212, first and second receive antennas 226*a* and 226*b*, and first through third transmit antennas 228*a* through 228*c*.

The antennas 226*a-b* are connected to receivers 220*a-c* and the antennas 228*a-c* are connected to transmitters 224*a-b* as shown. In an embodiment, one or more antennas may be used for both transmit and receive functionality by using duplexers/diplexers and other techniques known in the art to combine and separate the signals to/from the antennas.

In an embodiment, the receivers 220*a-b* and/or the transmitters 224*a-b* may be connected to a plurality of antennas and may use beam-forming to receive or transmit signals in a directional manner. In an embodiment, the second transmitter 224*b* performs beam-forming using the second transmit antenna 228*b* and the third transmit antenna 228*c* to focus a jamming signal towards an unlicensed eNodeB or a UE. In an embodiment, the second transmitter 224*b* uses beam forming to reduce the effect of the jamming signal on communications to and/or from a licensed eNodeB.

The receivers 220*a-b* receive radio frequency (RF) signals from receive antennas 226*a-b*, respectively. The receivers 220*a-b* process the RF signals in order to synchronize to and receive transmissions from wireless devices such as eNodeBs and UEs.

The intelligent jammer controller 204 includes computing resources for controlling the intelligent jammer 222, the computing resources including a Central Processor Unit (CPU) 230, a volatile Random Access Memory (RAM) 232, and/or a Non-Volatile RAM (NVRAM) 234. A person of skill in the art would understand that intelligent jammer controller 204 may further include items not shown in FIG. 2, such as busses, adapters, and input/output devices.

The intelligent jammer controller 204 receives information about the received transmissions from the receivers 220*a-b*. In an embodiment, the intelligent jammer controller 204 includes firmware and/or software components stored in the RAM 232, the NVRAM 234, or more generally in a non-transitory computer readable medium. An operation of the intelligent jammer controller 204 includes executing the firmware and/or software using the CPU 230.

The intelligent jammer controller 204 further includes one or more Universal Subscriber Identity Module, such as a first USIM 208*a* and a second USIM 208*b* shown in FIG. 2. The USIMs 208*a-b* include authentication facilities such as cryptographic application modules and associated credentials. The USIMs 208*a-b* further include network identity information. Accordingly, the intelligent jammer 222 is capable of presenting a plurality of network identities to a wireless network.

The first transmitter 224*a* receives first transmitter output signals from the intelligent jammer controller 204 and transmits first RF output signals using the first transmit antenna 228*b*. The second transmitter 224*b* receives second transmitter output signals from the intelligent jammer controller 204 and transmits second RF output signals using the second transmit antenna 228*b* and the third transmit antenna 228*c*. The first RF output signals and second RF output signals include jamming signals. In an embodiment, the second transmitter 224*b* transmitting the second RF output signals includes beam-forming the second RF output signals.

The wireless interface 210 and the wired interface 216 are connected to the intelligent jammer controller 204 and operate to provide communication between the intelligent jammer controller 204 and the licensed wireless system 120.

The wireless interface 210 provides wireless communication to a data communication network using the antenna 212. The wireless interface may include one or more of a WiFi adapter, a WiMax adapter, an LTE wireless subsystem, a satellite communication subsystem, a free-space optical communication interface, and/or other suitable wireless communication interfaces.

In an embodiment, the wireless interface 210 includes first receiver 220*a* and the antenna 212 includes the first antenna 226*a*. In an embodiment, the wireless interface 210 includes first transmitter 224*a* and/or second transmitter 224*b*, and the antenna 212 includes one or more of first through third transmit antennas 228*a* through 228*c*.

The wired interface 216 includes one or more of an Ethernet adapter, a Universal Serial Bus (USB) adapter, a Peripheral Component Interconnect (PCI) adapter, a PCI Express adapter, a fiber-optic communication interface, and/or other suitable interfaces.

In accordance with various embodiments of the disclosure, intelligent jammer controller 204 has presence and functionality that may be defined by the processes it can perform. Accordingly, a conceptual entity corresponding to the intelligent jammer controller 204 may be defined by its performance of processes associated with embodiments of the disclosure. Therefore, depending on the embodiment, the intelligent jammer controller 204 may be either a physical device and/or a software component that is stored in a non-transitory computer readable medium such as the RAM 232 or the NVRAM 234.

In an embodiment, an eNodeB includes an intelligent jammer such as intelligent jammer 222 shown in FIG. 2. The intelligent jammer may consist wholly or in part of resources ordinarily present in an eNodeB, such as, for example, antennas, receivers, transmitters, processors, and/or non-transitory computer readable media. In an embodiment, the intelligent jammer 222 of the eNodeB includes a computer program product embodied on a computer readable storage medium and executed by a processor of the eNodeB.

Figure 3:
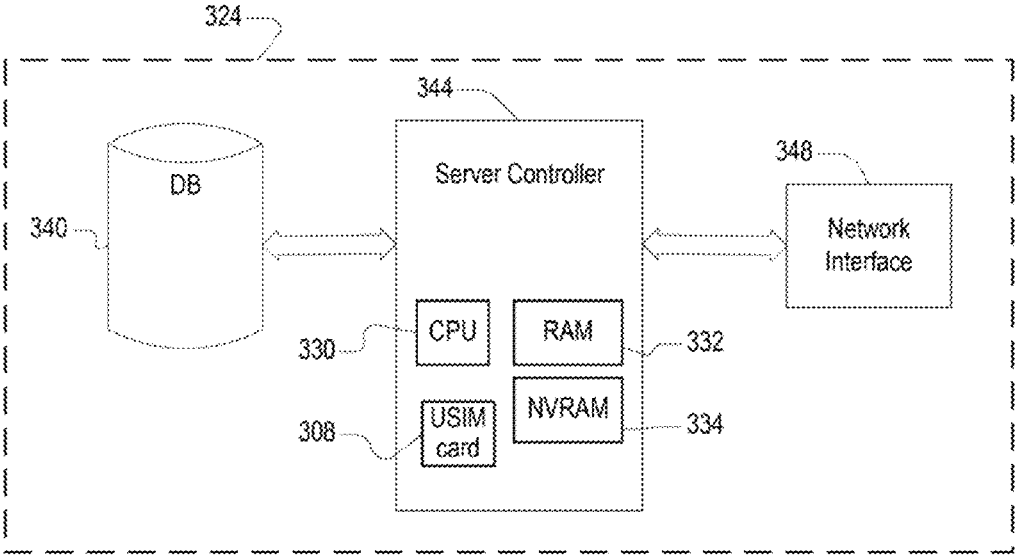
FIG. 3 is a block diagram of an intelligent detection and jamming server (IDJS) according to an embodiment.

FIG. 3 illustrates a block diagram of an IDJS 324 in accord with an embodiment of the disclosure, which can be used in conjunction with the intelligent jammer 222 of FIG. 2 and that may represent the IDJS 124 of FIG. 1. The IDJS 324 includes a database 340, a server controller 344, and a network interface 348.

An embodiment of the IDJS 324 may be portable and carried by a person, or mounted in a car, van, boat, aircraft, tethered balloon, remotely-piloted Unmanned Aerial Vehicle (UAV), or autonomous UAV.

The database 340 includes information associated with eNodeBs. The information associated with the eNodeBs may include geographic information, eNodeB identifiers, wireless spectrum information, and licensing information.

In an embodiment, the database 340 includes one or more remote databases accessed using the network interface 348. In an embodiment, a database is provided by a licensed wireless network operator. In an embodiment, the IDJS 324 includes a cache of recent and/or commonly-used information received from a remote database.

The server controller 344 includes computing resources for controlling the IDJS 324, the computing resources including a processor or Central Processing Unit (CPU) 330, RAM 334, and NVRAM 334. A person of skill in the art would understand that server controller 344 may further include items not shown in FIG. 3 such as busses, adapters, and input/output devices.

The server controller 344 reads and writes information in the database 340. The server controller 344 sends and receives commands and information using the network interface 348. An operation of the server controller 344 includes using CPU 330 to execute computer instructions contained in a non-transitory computer-readable medium such as RAM 334 or NVRAM 324.

The server controller 344 further includes a USIM 308. The USIM 308 includes authentication facilities such as cryptographic application modules and associated cryptographic keys. The USIM 308 further includes network identity information. In an embodiment, the USIM 308 is an emulated USIM.

In an embodiment, the IDJS 324 includes a log including authentication reports for authentications performed using USIMs, each report including an indication of whether an authentication protocol was successfully completed. The USIMs may be USIMs of intelligent jammers and/or UEs. In an embodiment, the server controller 344 does not include a USIM.

In accordance with various embodiments of the disclosure, server controller 344 has presence and functionality that may be defined by the processes it is capable of carrying out. Accordingly, a conceptual entity corresponding to the server controller 344 may be defined by its performance of processes associated with embodiments of the disclosure. Therefore, depending on the embodiment, the server controller 344 may be either a physical device and/or a software component that is stored in a non-transitory computer readable media such as the RAM 332 or the NVRAM 334.

The network interface 348 provides communications between the server controller 344 and other devices in the network environment 100. The network interface 348 can be a wired or wireless network interface, including one or more of an Ethernet adapter, a Universal Serial Bus (USB) adapter, a Peripheral Component Interconnect (PCI) adapter, a PCI Express adapter, a WiFi adapter, a WiMax adapter, an LTE wireless subsystem, a satellite communication subsystem, a fiber-optic or free-space optical communication interface, and/or other suitable interfaces.

Figure 4:
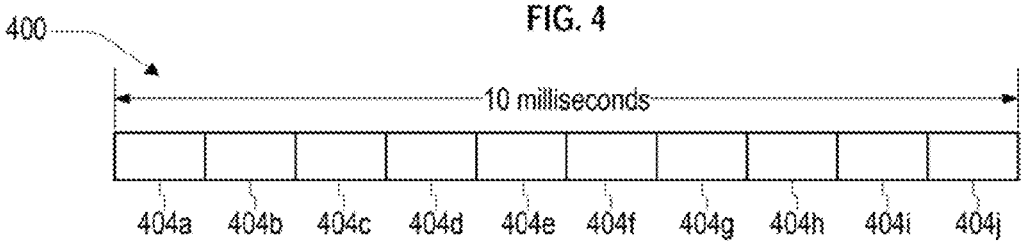
FIG. 4 depicts a structure of a Long Term Evolution (LTE) frame.
Figure 5:
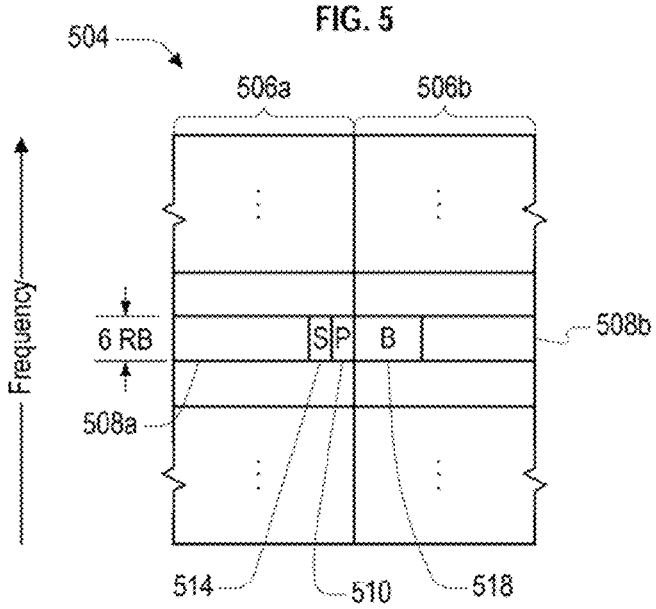
FIG. 5 depicts a structure of an LTE downlink (DL) subframe.
Figure 6:
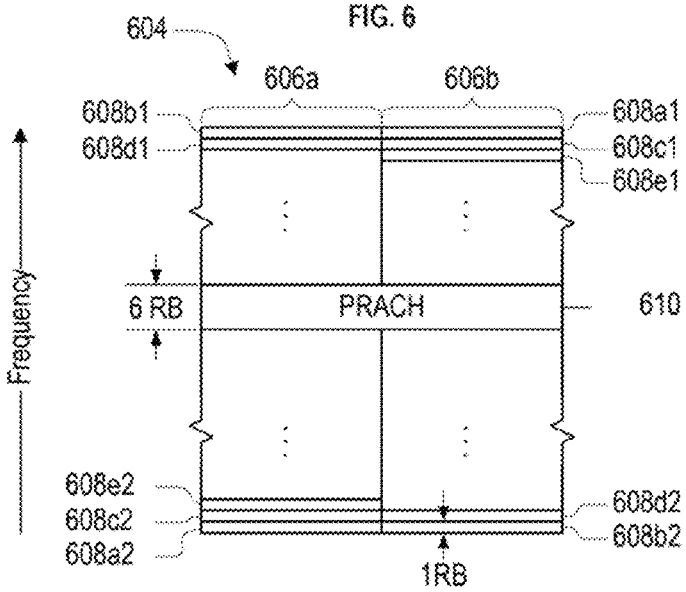
FIG. 6 depicts a structure of an LTE uplink (UL) subframe.

FIGS. 4-6 depict the structure of LTE transmission elements and provides context for the operation of the intelligent jammer 222 and the IDJS 324.

FIG. 4 depicts an LTE frame 400. The LTE frame 400 is 10 milliseconds in duration and includes first through tenth subframes 404*a* through 404*j*, each having a one millisecond duration.

The LTE frame 400 includes a plurality of protocol signals for synchronizing, connecting, and allocating resources to devices in a wireless network. The protocol signals are transmitted at times and frequencies within the LTE frame 400. A person of ordinary skill in the art in light of the teachings and disclosures herein would understand how to determine a time and a frequency for a protocol signal of the LTE frame 400 using signals received from an eNodeB and/or a UE.

The protocol signals transmitted by an eNodeB during DL communications include a Primary Synchronization Signal (PSS), a Secondary Synchronization Signal (SSS), and a Broadcast Channel (BCH) signal, as shown in FIG. 5, below. The protocol signals transmitted by a UE during UL communications includes a Physical Random Access Channel (PRACH) signal and a Physical Uplink Control Channel (PUCCH) signal, as shown in FIG. 6, below.

FIG. 5 depicts a DL subframe 504 which may be included in an LTE frame 400 during DL communications, the DL communications using a DL channel. The DL subframe 504 includes a first slot 506*a* and a second slot 506*b*, each 500 microseconds in duration. Slots within the LTE frame 400 are designated numerically, with slot 0 being a first slot in the first subframe 404*a*, slot 1 being a second slot in the first subframe 404*a*, slot 2 being a first slot in the second subframe 404*b*, and so on.

The DL subframe 504 is transmitted using Orthogonal Frequency Division Multiplexing (OFDM) using multiple subcarriers each having a frequency. Sets of twelve adjacent subcarriers in each of the first slot 506*a* and the second slot 506*b* form Resource Blocks (RBs).

A first RB group 508*a* comprises six RBs in the first slot 506*a*, the six RBs including 72 center subcarriers. A second RB group 508*b* comprises six RBs in the second slot 506*a*, the six RBs including 72 center subcarriers.

The first RB group 508*a* includes a Primary Synchronization Signal (PSS) 510 comprising information related to an initial synchronization and to a cell identification. The first RB group 508*a* also includes a Secondary Synchronization Signal (SSS) 514 comprising information related to the cell identification and to a cyclic prefix length. The PSS 510 and the SSS 514 are located in the first slot of the first subframe 404*a* and in the first slot of the sixth subframe 404*f* (that is, slots 0 and 10) of LTE frame 400 during DL communications.

The PSS 510 and SSS 514 are used in an initial access procedure performed by a UE. In the initial access procedure, the UE performs subframe, slot, and symbol synchronization and determines a center frequency of the DL channel using the PSS 510. The UE performs frame synchronization using the SSS 514. Also, the UE determines a Physical layer Cell Identity (PCI) using both the PSS 510 and the SSS 514. The UE uses the PCI to determine the location within the LTE frame 400 of reference signals RS related to channel estimation, cell selection and reselection, and handover procedures.

The second RB group 508*b* includes a Broadcast Channel (BCH) signal 518. The BCH signal 518 includes a Master Information Block (MIB). The BCH signal 518 is found in the first slot of the first subframe 404*a* (that is, slot 0) of the LTE frame 400 during DL communications.

A UE uses the MIB included in the BCH signal 518 to determine a DL system bandwidth, a Physical Hybrid Automatic Repeat reQuest (ARQ) Indicator Channel (PHICH) structure, and the most significant eight bits of a system frame number. The UE uses the system frame number as a timing reference.

FIG. 6 shows an UL subframe 604 which may be included in LTE FDD frame 400 during UL communications, the UL communications using an UL channel. The UL subframe 604 includes a first slot 506*a* and a second slot 506*b*, each 500 microseconds in duration.

The UL subframe 604 is transmitted using OFDM using multiple subcarriers each having a frequency. Sets of twelve adjacent subcarriers in each of the first slot 606*a* and the second slot 606*b* form Resource Blocks (RBs).

A Physical Random Access Channel (PRACH) 610 comprises 6 adjacent RBs in each of the first slot 606*a* and the second slot 606*b*. The PRACH 610 is used to access the network in non-synchronized mode, such as when a UE initially signals its presence in a cell to an eNodeB of the cell. The PRACH 610 is also used to synchronize timing. A signal previously received through the DL channel determines which RBs are used for the PRACH 610, and different eNodeBs may use different RBs for the PRACH.

The UL subframe 604 includes a plurality of Physical Uplink Control Channels (PUCCHs) each comprising a pair of RBs located near edges of the UL channel bandwidth. Thus, a first PUCCH includes a first upper RB 608*a*1 and a first lower RB 608*a*2, a second PUCCH includes a first upper RB 608*b*1 and a first lower RB 608*b*2, and so on. Each upper and lower RB in a PUCCH is in a different slot of the subframe 604, with the upper RB of each PUCCH being above the center subcarriers and the lower RB of each PUCCH being below the center subcarriers.

Each PUCCH includes a Hybrid ARQ signal, a channel quality indicator (CQI) signal, a Multiple-In and Multiple-Out (MIMO) feedback signal, and/or a scheduling request for an UL transmission. The PUCCHs use RBs that are always near the edges of the UL channel bandwidth, and therefore the PUCCHs may be more readily jammed than signals using RBs near a center of the UL channel bandwidth.

Figure 7:
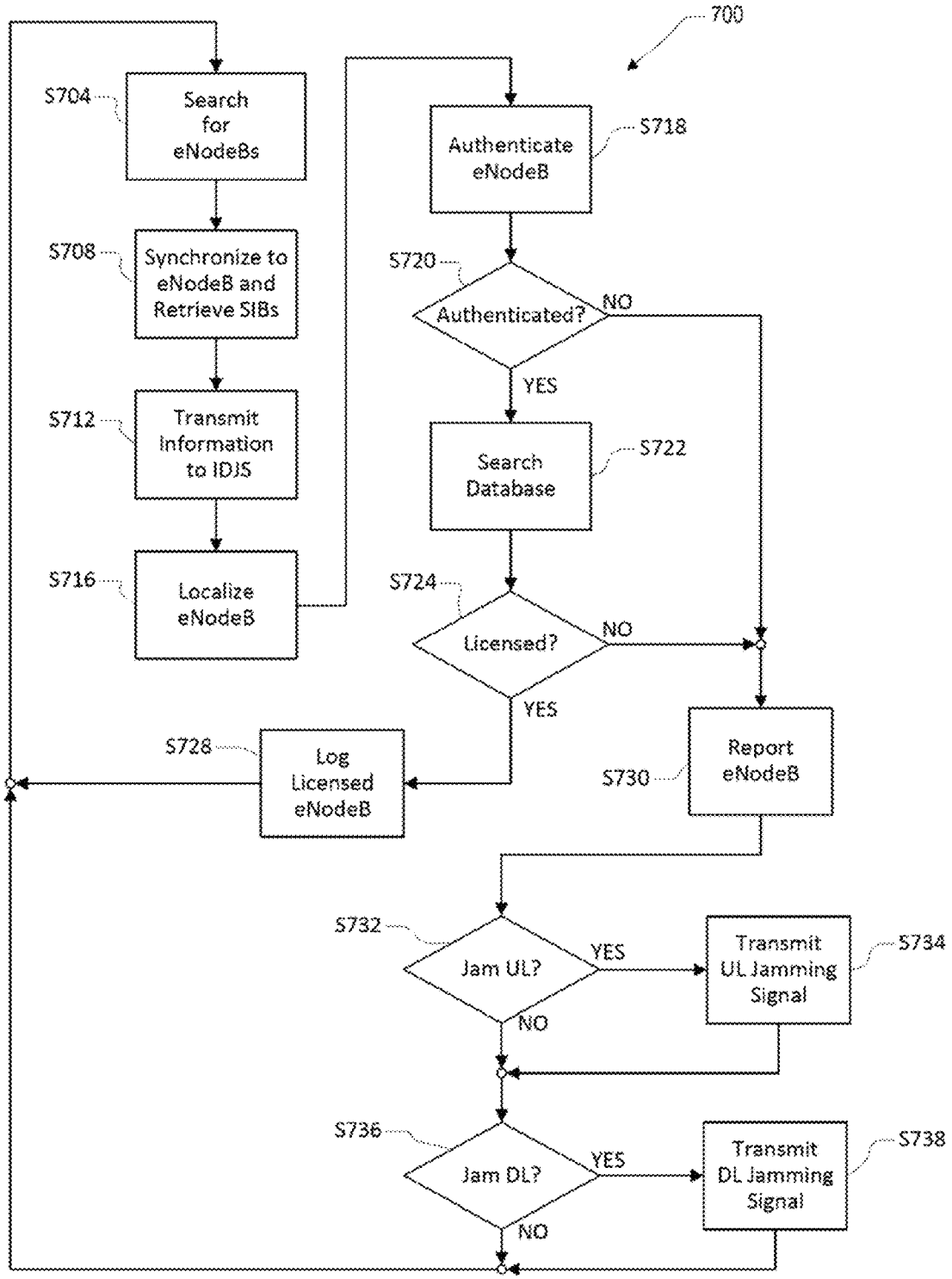
FIG. 7 illustrates a process for jamming an unlicensed wireless network according to an embodiment.

FIG. 7 is a flowchart of an embodiment of a process 700 of detecting and jamming an unlicensed wireless network using an intelligent jamming system such as the intelligent jamming system including IDJS 124 and one or more intelligent jammers 122 shown in FIG. 1.

At S704, an IDJS initiates a search for eNodeBs by transmitting a sniff command signal to an intelligent jammer. When the sniff command signal is received by the intelligent jammer, the intelligent jammer begins to search for eNodeBs by receiving RF signals. In an embodiment, the IDJS also transmits the sniff command to one or more additional intelligent jammers, one or more eNodeBs, one or more UEs, or a combination thereof.

At S708, the intelligent jammer detects a signal source by receiving an RF signal comprising an LTE frame. The received LTE frame includes a received DL subframe. The intelligent jammer uses a PSS, a SSS, and/or a BCH of the received DL subframe to perform symbol, slot, subframe, and/or frame synchronization and to determine information about the source of the received LTE frame, including information related to a System Information Block (SIB).

In an embodiment, the intelligent jammer also determines information about the source of the received LTE frame using the strength and/or direction of the received RF signal.

At S712, the intelligent jammer transmits information gathered at S708 to the IDJS. In an embodiment, the information includes samples taken from the received RF signal. In an embodiment, a UE and/or an eNodeB also transmit information related to a received LTE frame to the IDJS. In an embodiment, the information transmitted to the IDJS includes information that an RF signal comprising an LTE frame was not received.

At S716, the location of the source of the received LTE frame is estimated. Estimating the location of the source of the received LTE frame includes using information from one or more intelligent jammers, one or more UEs, one or more eNodeBs, or a combination thereof. Estimating the location of the source includes using a triangulation according to directions of received signals and/or a trilateration based on characteristics of the received signals.

Information used to estimate the location of the source of the received LTE frame may include a signal power, a signal direction, a signal propagation time, a channel estimation parameter, an absence of a signal, an interference metric, or a combination thereof. Information used to estimate the location of the source may further include a location of a source of the information, such as a location of intelligent jammers determined using the Global Positioning System (GPS), information from a licensed eNodeB, etcetera.

At S718, the source of the received LTE frame is authenticated in accordance with an authentication protocol such as the LTE Authentication and Key Agreement (AKA) protocol. In an embodiment, the authentication protocol is performed using one or more intelligent jammers including using one or more USIMs thereof, either autonomously or as directed by the IDJS. The authentication protocol may be performed using a USIM or an emulated USIM included in the IDJS and using one or more intelligent jammers, one or more UEs, or a combination thereof. In an embodiment, the USIM or the emulated USIM used to perform the authentication protocol is provided by a licensed wireless network operator.

In an embodiment, the authentication protocol includes receiving a network authentication token (AUTN) from the source of the received LTE frame and authenticating the received AUTN using a USIM or an emulated USIM. If an AUTN is not timely received or fails to authenticate, the authentication protocol fails and accordingly the source of the received LTE frame is not authenticated.

At S720, if the source of the received LTE frame is not authenticated, the source of the LTE frame is categorized as an unlicensed eNodeB and the process 700 proceeds to S730. Otherwise, the source of the received LTE frame is categorized as an authenticated eNodeB and the process 700 proceeds to S722.

At S722, a database is queried for information related to the authenticated eNodeB. The database includes information related to licensed eNodeBs. The database may also include information related to previously-detected unlicensed eNodeBs.

The information related to licensed eNodeBs or unlicensed eNodeBs includes location information, wireless spectrum information, and/or LTE identifier information. The LTE identifier information includes eNodeB identifiers, for example, a Public Land Mobile Network ID (PLMN ID), a Mobile Country Code (MCC), a Mobile Network Code (MNC), a Tracking Area Code (TAC), and/or an E-UTRAN Cell Global ID (ECGI).

At S724, whether the authenticated eNodeB is a licensed eNodeB is determined according to the results of the query performed at S722. For example, when an estimated location and/or other information related to an authenticated eNodeB corresponds to a registered location and/or other information associated in the database with a licensed eNodeB, the authenticated eNodeB is determined to be a licensed eNodeB. In another example, when an estimated location and/or other information related to an authenticated eNodeB corresponds to a location and/or other information associated in the database with an unlicensed eNodeB, the authenticated eNodeB is determined to not be a licensed eNodeB.

When the authenticated eNodeB is determined to be a licensed eNodeB, the process 700 proceeds to S728. Otherwise the authenticated eNodeB is categorized as an unlicensed eNodeB and the process 700 proceeds to S730.

At S728, the information associated with the source determined to be a licensed eNodeB is logged. Logging the licensed eNodeB includes updating the information associated with the licensed eNodeB in the database, including updating operational parameters of the licensed eNodeB.

At S730, the source determined to be an unlicensed eNodeB is reported. The reporting includes sending information related to the unlicensed eNodeB to a licensed wireless network operator and/or to a governmental agency. In an embodiment, the reporting includes logging the unlicensed eNodeB in a manner similar to that described in S728 above, including storing and/or updating information associated with the unlicensed eNodeB in the database.

At S732, whether to jam a UL channel of the unlicensed eNodeB is determined. Whether to jam the UL channel of the unlicensed eNodeB may be determined according to an anticipated effectiveness of the UL jamming, an anticipated effect that the UL jamming would have on a licensed eNodeB or a wireless device communicating therewith, and/or a capability of an intelligent jammer.

In an embodiment, an IDJS determines whether to jam the UL channel of the unlicensed eNodeB. When the IDJS determines to jam the UL channel, the IDJS instructs one or more intelligent jammers to jam the UL channel.

At S734, UL jamming signals specifically adapted to UL communication to the unlicensed eNodeB are generated and transmitted. In an embodiment, the UL jamming signals are transmitted by one or more intelligent jammers in response to instructions transmitted by the IDJS. The UL jamming signals are transmitted in a UL channel of the unlicensed eNodeB.

At S736, whether to jam a DL channel of the unlicensed eNodeB is determined. Whether to jam the DL channel of the unlicensed eNodeB may be determined according to an anticipated effectiveness of the DL jamming, an anticipated effect that the DL jamming would have on a licensed eNodeB or a wireless devise communicating therewith, and/or a capability of an intelligent jammer.

In an embodiment, determining whether to jam a DL channel of the unlicensed eNodeB includes determining whether one or more intelligent jammers detected a UL transmission from a UE during a quiet time during which no licensed wireless system devices were expected to be transmitting. Detection of a UL transmission during the quiet time indicates that a UE near the one or more intelligent jammers may be attempting communication with an unlicensed eNodeB. When the UL transmission is detected during the quiet time, the one or more intelligent jammers may be instructed to generate DL jamming signals.

In an embodiment, an IDJS determines whether to jam the DL channel of the unlicensed eNodeB. When the IDJS determines to jam the DL channel, the IDJS instructs one or more intelligent jammers to jam the DL channel.

At S738, DL jamming signals adapted to prevent or degrade communication with the unlicensed eNodeB are generated. In an embodiment, the DL jamming signals are generated by an intelligent jammer in response to instructions transmitted by an IDJS. The DL jamming signals are transmitted in a DL channel of the unlicensed eNodeB.

The jamming signals may have a frequency corresponding to a frequency of a subcarrier associated with an LTE synchronization signal and/or an LTE control channel used by the unlicensed eNodeB. The LTE synchronization signals include a PSS and a SSS. The LTE control channels include a PRACH, one or more PUCCHs in an UL channel, and a BCH in a DL channel.

In an embodiment, the jamming signals are transmitted only at times when other wireless network equipment is expected to transmit and/or at frequencies that other wireless network equipment is expected to use. In an embodiment, the intelligent jammer transmits the jamming signals at a time and a frequency corresponding to a time and a frequency of an expected transmission to or from the unlicensed eNodeB according to resource allocation information transmitted in the DL channel of the unlicensed eNodeB.

In an embodiment, a first intelligent jammer is instructed to jam an UL channel of the unlicensed eNodeB, and a second intelligent jammer is instructed to jam a DL channel of the unlicensed eNodeB. The first intelligent jammer may be selected according to a proximity to the unlicensed eNodeB. The second intelligent jammer may be selected according to a proximity to a UE in communication with the unlicensed eNodeB.

In an embodiment, an intelligent jammer with a lowest RF path loss to the unlicensed eNodeB is used to transmit the jamming signals on a UL channel of the unlicensed eNodeB. In an embodiment, an intelligent jammer with a lowest RF path loss to a UE in communication with the unlicensed eNodeB is used to transmit the jamming signals on a DL channel of the unlicensed eNodeB.

Figure 8:
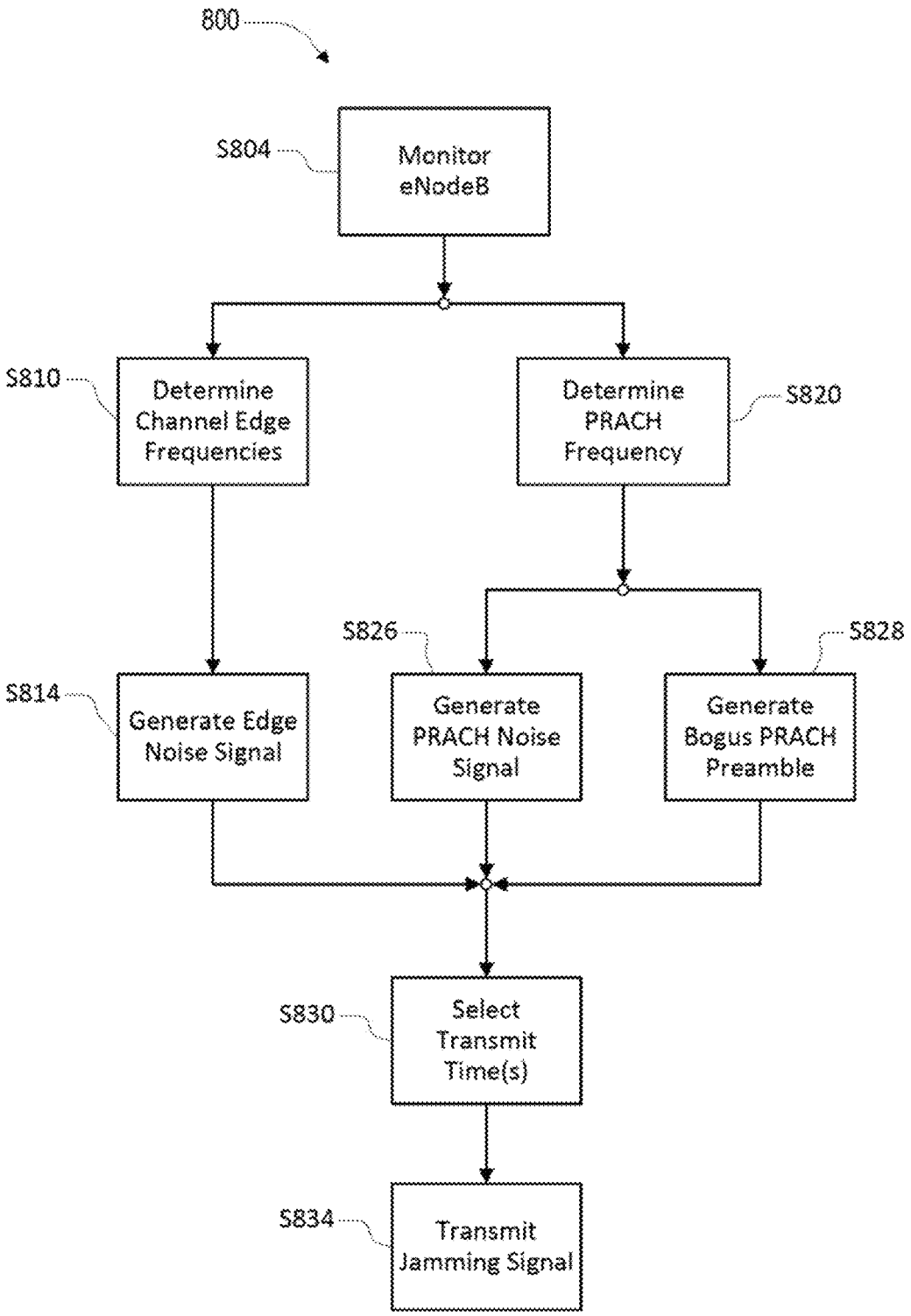
FIG. 8 illustrates a process for generating UL jamming signals according to an embodiment.

FIG. 8 illustrates an embodiment of a process 800 of generating and transmitting a UL jamming signal according to an embodiment. The process 800 corresponds to S734 of the process 700 of FIG. 7.

At S804, an eNodeB is monitored to determine information associated with the eNodeB. Monitoring the eNodeB includes receiving RF signals, which may be RF signals containing LTE frames.

The information associated with the eNodeB may be a DL channel center frequency, a DL channel bandwidth, a geographic location, an RF signal strength, an RF signal direction, a frame start time, MIB information, a time of a protocol signal, a frequency of a protocol signal, or a combination thereof.

In various embodiments, a PUCCH, a PRACH, or both a PUCCH and a PRACH may be jammed. The PRACH may be jammed using a PRACH noise signal, a bogus PRACH preamble, or both. In an embodiment, portions of the process S800 that generate signals not used to jam a PUCCH or PRACH are not performed.

For jamming the PUCCHs, at S810, edge frequencies associated with the one or more PUCCHs are determined Because a PUCCH uses RBs near the edges of the UL channel, that is, RBs that include subcarriers having frequencies near the bottom and top of the UL channel, in an embodiment a pair of edge frequencies are determined for each of the one or more PUCCHs.

At S814, edge noise signals are generated at the edge frequencies identified at S810. The edge noise signals may be a white noise signal, pink noise signal, Brownian noise signal, or some other kind of noise signal. The edge noise signals are UL jamming signals.

Turning to jamming the PRACH, at S820, a jamming frequency corresponding to a frequency of the PRACH is determined using the information associated with the eNodeB. If the information captured at S704 indicates that the eNodeB has changed the frequency of the PRACH, the jamming frequency is changed accordingly.

At S826, the PRACH noise signal is generated at the jamming frequency. The PRACH noise signal includes a white noise signal, pink noise signal, Brownian noise signal, or some other kind of noise signal. The PRACH noise signal is a UL jamming signal.

At S828, the bogus PRACH preamble signal is generated at the jamming frequency. The bogus PRACH preamble signal is similar to the PRACH preamble used by the eNodeB. The bogus PRACH preamble signal is adapted to increase the PRACH detection failure rate of the eNodeB. The bogus PRACH noise preamble is a UL jamming signal.

In an embodiment, the bogus PRACH preamble signal is adapted to cause the eNodeB to generate a random access response message with a preamble ID, a timing adjustment, a Temporary Cell Radio Network Temporary Identifier (TC-RNTI), and a scheduling grant.

In an embodiment, a sequence and/or a timing of the bogus PRACH preamble signal are altered. The alteration of the sequence and/or the timing of the PRACH preamble signal is adapted to prevent a determination by the eNodeB that the bogus PRACH preamble signal is a bogus signal. The alteration of the sequence and/or the timing of the bogus PRACH preamble signal may occur at a predetermined interval or according to information associated with the eNodeB. For example, the alteration may occur when a change in a response of the eNodeB to the bogus PRACH preamble signal occurs, including the eNodeB ceasing to respond to the bogus PRACH preamble signal.

At S830, one or more UL jamming transmission times are determined for the UL jamming signal. The one or more UL jamming transmission times are determined according to information associated with the eNodeB.

In an embodiment, the UL jamming transmission time corresponds to one or more times allocated by the eNodeB to a UE for a UL transmission. Each of the one or more times allocated to the UEs can be for UL control transmission or UL data transmission.

In an embodiment, in order to jam only one or more target UEs, only times allocated to the one or more target UEs are used as UL jamming transmission times. In addition, the frequencies of the UL jamming signals may be determined according to frequencies allocated to the one or more target UEs. In an embodiment, only UL jamming signals having frequencies corresponding to frequencies of one or more PUCCHs allocated by the eNodeB to the one or more targeted UEs are used.

At S834, the one or more UL jamming signals generated at S814, 826, or 828 are transmitted at the one or more UL jamming transmission times. In an embodiment, the one or more transmitted UL jamming signal are directed towards the eNodeB using a directional antenna or by performing beam forming using multiple antennas.

Figure 9:
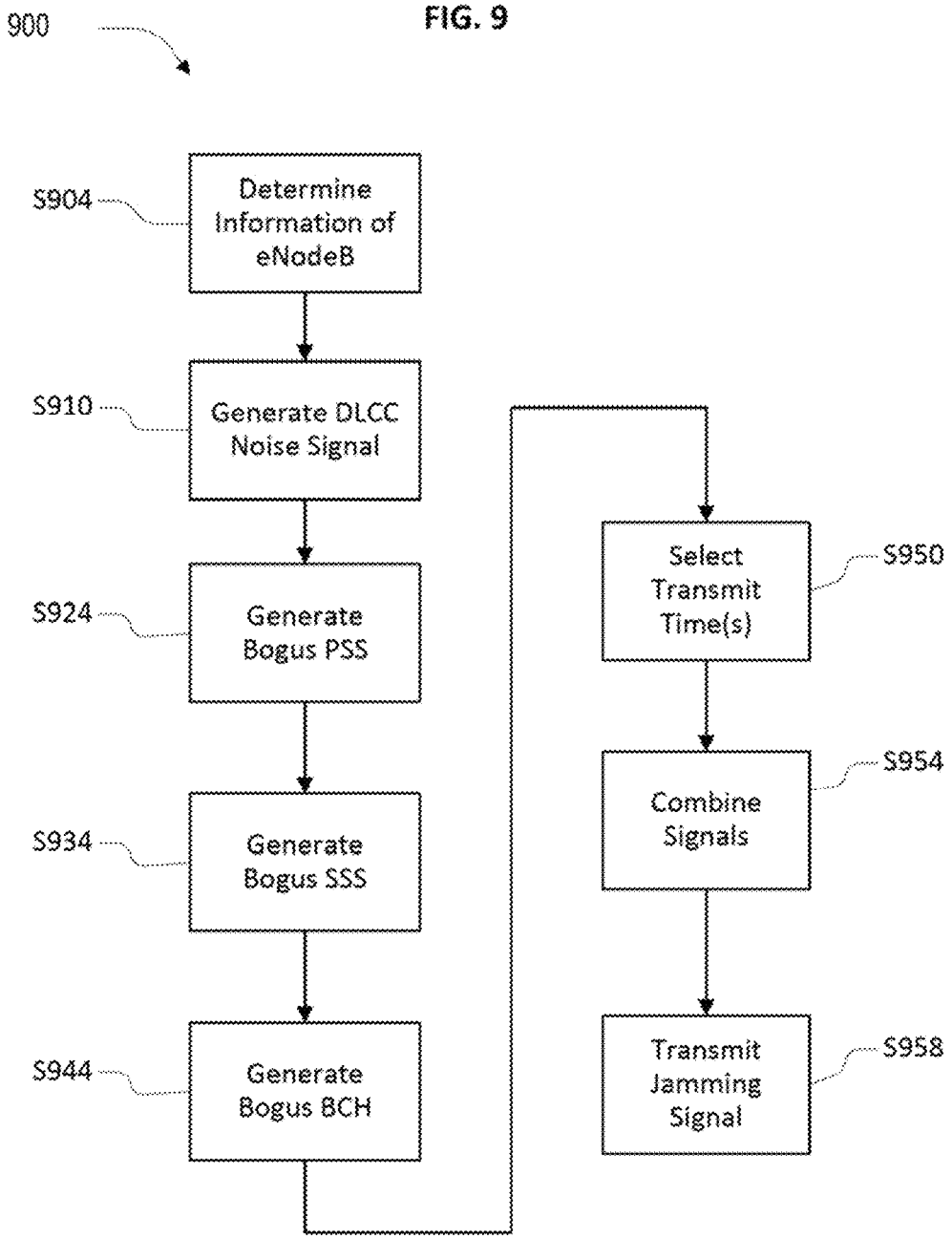
FIG. 9 illustrates a process for generating DL jamming signals according to an embodiment.

FIG. 9 illustrates of a process 900 of generating and transmitting a DL jamming signal according to an embodiment. The process 900 corresponds to S738 of the process 700 of FIG. 7.

At S904, system information associated with the eNodeB is determined. The determined system information includes a channel bandwidth and a channel center frequency of the eNodeB. The determined system information relates to synchronizing the jamming signals with the transmissions from the eNodeB. In an embodiment, determining the system information includes periodically tracking the system information.

At S910, a Downlink Channel Center (DLCC) noise signal is generated according to the system information associated with the eNodeB. The DLCC noise signal includes a frequency corresponding to a frequency of the center 72 subcarriers of the DL channel. The frequency of the DLCC noise signal is modulated using white noise, pink noise, or Brownian noise.

At S924, one or more bogus PSS signals are generated. Each PSS signals is a bogus DL sync signal and includes a plurality of PSS symbols located in RBs of a subframe of an LTE frame. The RBs of each bogus PSS signal correspond to RBs used by legitimate PSS signals. The PSS symbols and/or the subframe of each bogus PSS signals may be changed periodically to prevent a UE from recognizing a bogus PSS signal as being bogus.

In an embodiment, a subframe of a bogus PSS signal corresponds to a subframe used by legitimate PSS signals. In an embodiment, a subframe of a bogus PSS signal corresponds to a subframe not used by legitimate PSS signals, so as to increase the probability that the UEs receiving transmissions from the eNodeB will not properly detect an LTE frame boundary.

At S934, one or more bogus SSS signals are generated. Each bogus SSS signal is a bogus DL sync signal and includes a plurality of SSS symbols located in RBs of a subframe of an LTE frame. The RBs of each bogus SSS signal correspond to RBs used by legitimate SSS signals. The SSS symbols and/or the subframe of each bogus SSS signal may be changed periodically to prevent a UE from recognizing each bogus SSS signal as being bogus.

In an embodiment, a subframe of a bogus SSS signal corresponds to a subframe used by legitimate SSS signals. In an embodiment, a subframe of a bogus SSS signal corresponds to a subframe not used by legitimate SSS signals, so as to increase the probability that the UEs receiving transmissions from the eNodeB will not properly detect an LTE frame boundary.

At S944, one or more bogus BCH signals are generated. Each bogus BCH signal is a bogus DL sync signal and includes a plurality of symbols located in the RBs of a subframe of an LTE frame. The RBs used by each bogus BCH signal correspond to the RBs used by legitimate BCH signals.

In an embodiment, a subframe of a bogus BCH signal corresponds to a subframe used by legitimate BCH signals. In an embodiment, a subframe of a bogus BCH signal corresponds to a subframe not used by legitimate BCH signals so as to increase the probability that the UEs receiving transmissions from the eNodeB will not properly detect an LTE frame boundary.

At S950, one or more DL jamming transmission times for the bogus DL sync signals and the DLCC noise signal are determined.

In an embodiment, a DL jamming transmission time is determined according to resource allocation information from downlink control channels associated with the eNodeB. The DL jamming transmission time corresponds to a time used by the eNodeB to transmit data on a downlink shared data channel (DL-SCH) to a UE.

In an embodiment, a DL jamming transmission time is determined according to an activity of a UE. The DL jamming transmission time is a time following a detection of a UL transmission by the UE to the eNodeB.

At S954, the bogus DL sync signals and the DLCC noise signal are combined according to the DL jamming transmission times to generate a DL jamming signal. In various embodiments, one or more DLCC noise signals, one or more bogus PSS, one or more bogus SSS, one or more bogus BCH, or combinations are combined to generate the DL jamming signal.

For example, the DL jamming signal may include only one or more DLCC noise signals, only one or more bogus PSS signals, only one or more PSS signals and one or more bogus SSS signals, etcetera. In an embodiment, portions of the process S900 that generate signals not included in the DL jamming signal are not performed.

At S958, the one or more DL jamming signals are transmitted at the one or more DL jamming transmission times. In an embodiment, a transmitted DL jamming signal is directed towards an UE using a directional antenna and/or by performing beam forming using multiple antennas. In an embodiment, one or more intelligent jammers are selected to transmit a DL jamming signal according to a proximity of the intelligent jammers to a UE.

FIGS. 10-13 depict embodiments of locations of DL jamming signals in an LTE frame.

Figure 10:
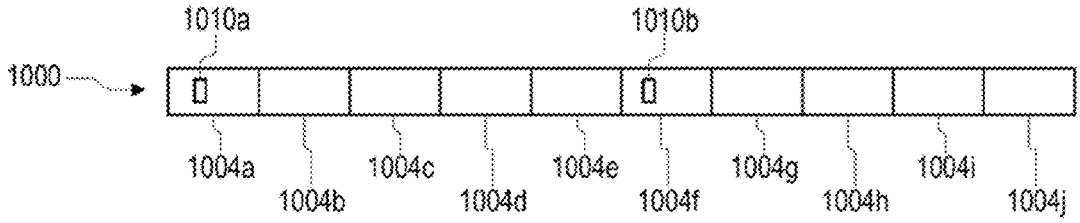
FIGS. 10-13 depict LTE frames including DL jamming signals according to an embodiment.

FIG. 10 depicts an LTE frame 1000 including a first bogus PSS signal 1010*a* and a second bogus PSS signal 1010*b*. The LTE frame 1000 comprises first through tenth subframes 1004*a* through 1004*j*, each subframe consisting of a first slot and a second slot.

The bogus PSS signals 1010*a* and 1010*b* are in the RBs corresponding to RBs used by legitimate PSS signals. That is, the first bogus PSS signal 1010*a* is in six RBs including the 62 center subcarriers excluding the DC subcarrier of the first slot of the first subframe 1004*a*, and the second bogus PSS signal 1010*b* is in six RBs including the 72 center subcarriers of the first slot of the sixth subframe 1004*f*.

Figure 11:
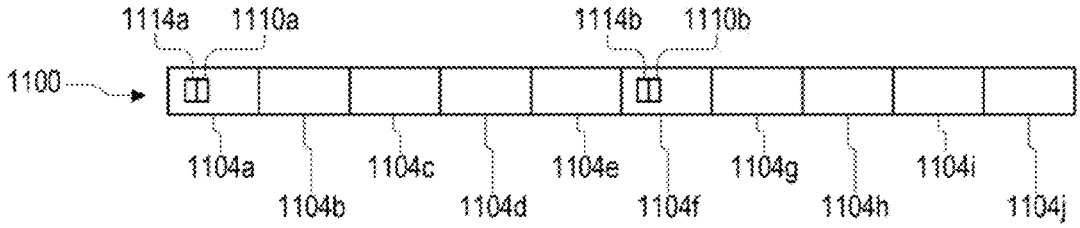

FIG. 11 depicts an LTE frame 1100 including a first bogus SSS signal 1114*a* and a second bogus SSS signal 1114*b*. The LTE frame 1100 comprises first through tenth subframes 1104*a* through 1104*j*, each subframe consisting of a first slot and a second slot. The LTE frame 1100 further includes a first bogus PSS signal 1110*a* and a second bogus PSS signal 1110*b*.

The bogus SSS signals 1114*a* and 1114*b* are in RBs corresponding to RBs used by legitimate SSS signals. That is, the first bogus SSS signal 1114*a* is in six RBs including the 62 center subcarriers excluding the DC subcarrier of the first slot of the first subframe 1104*a*, and the second bogus SSS signal 1114*b* is in six RBs including the 62 center subcarriers excluding the DC subcarrier of the first slot of the sixth subframe 1104*f*.

Figure 12:
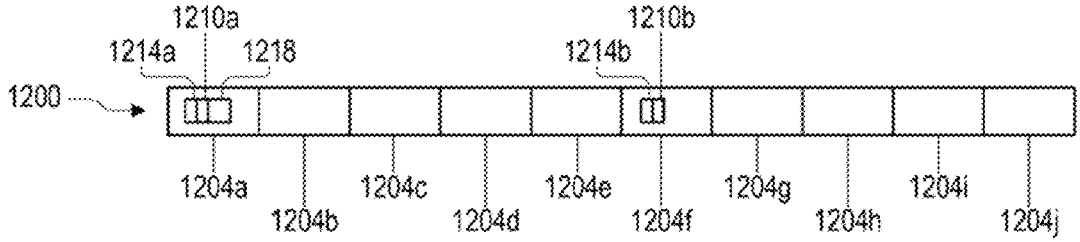

FIG. 12 depicts an LTE frame 1200 including bogus BCH signal 1218. The LTE frame 1200 comprises first through tenth subframes 1204*a* through 1204*j*, each subframe consisting of a first slot and a second slot. The LTE frame 1200 further includes a first bogus PSS signal 1210*a*, a second bogus PSS signal 1210*b*, a first bogus SSS signal 1214*a*, and a second bogus SSS signal 1214*b*.

The bogus BCH signal 1218 is in RBs corresponding to RBs used by legitimate BCH signals. That is, the bogus BCH signal 1218 is in the six RBs including the 72 center subcarriers of the second slot of the first subframe 1204*a*.

Figure 13:
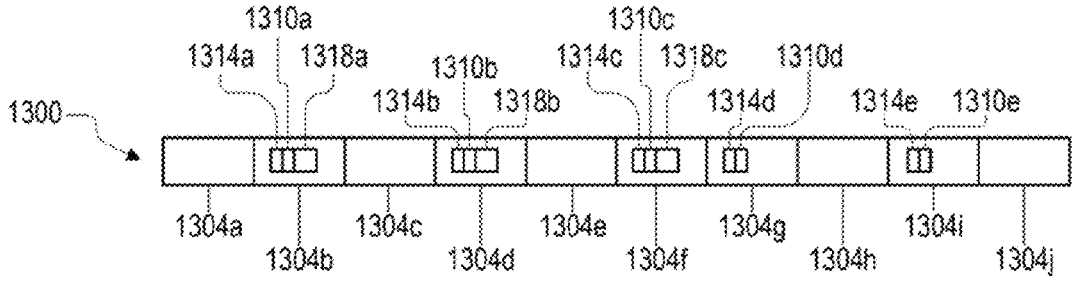

FIG. 13 depicts an LTE frame 1300 including a plurality of bogus DL sync signals. The LTE frame 1300 comprises first through tenth subframes 1304*a* through 1304*j*, each subframe consisting of a first slot and a second slot.

The bogus DL sync signals of LTE frame 1300 include first through fifth bogus PSS signals 1310*a* through 1310*e*, first through fifth bogus SSS signals 1314*a* through 1314*e*, and first through third bogus BCH signals 1318*a* through 1318*c*.

The bogus DL sync signals of LTE frame 1300 are located in RBs of their respective subframes that correspond to RB locations associated with their legitimate counterparts. However, all of the bogus DL sync signals of LTE frame 1300 except for the third bogus PSS signal 1310*c* and the third bogus SSS signal 1314*c* are located in subframes other than the subframes used by their legitimate counterparts. Accordingly, the LTE frame 1300 when transmitted jams a DL channel by, among other things, increasing the probability that a UE receiving the LTE frame 1300 will not detect a correct frame boundary.

Figure 14:
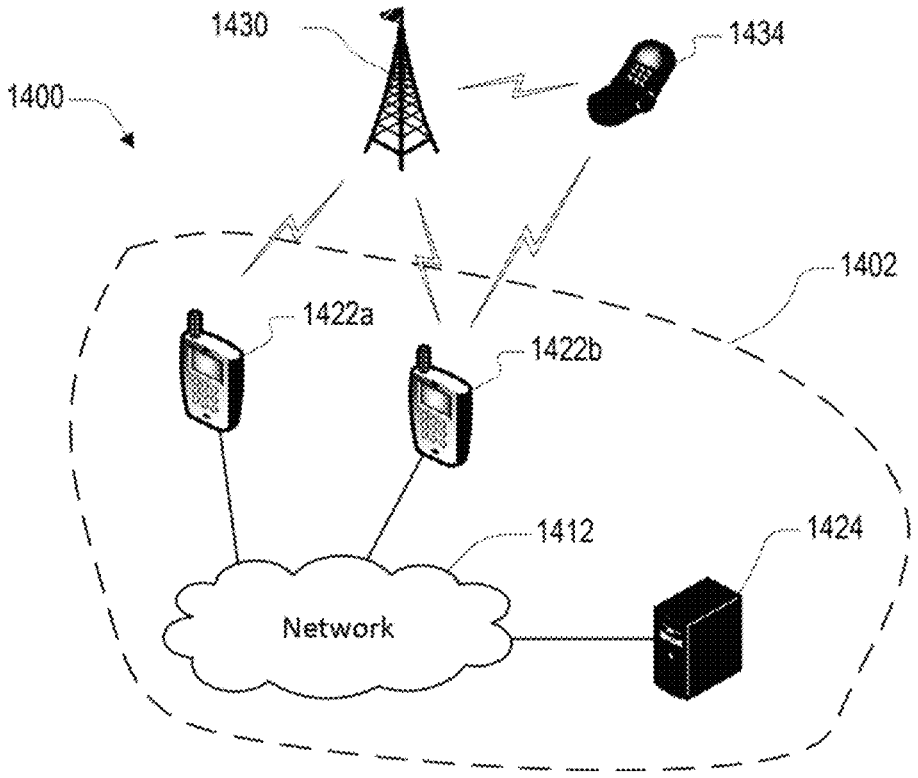
FIG. 14 depicts an intelligent jamming system according to an embodiment.

FIG. 14 depicts an intelligent jamming system 1402 according to an embodiment. The intelligent jamming system 1402 operates in a wireless network environment 1400. The wireless network environment 1400 includes an unlicensed eNodeB 1430 and a UE 1434 communicating with the unlicensed eNodeB 1430.

The unlicensed eNodeB 1430 provides wireless communication services to the UE 1434. The unlicensed eNodeB 1430 and the UE 1434 operate together to form an unlicensed wireless system. The unlicensed wireless system 140 may operate in an isolated geographic area outside of the geographic areas covered by a licensed wireless system.

An IDJS 1424, a first intelligent jammer 1422*a*, and a second intelligent jammer 1422*b* are deployed in the wireless network environment 1400. IDJS 1424 may include the IDJS 324 shown in FIG. 3, and each of intelligent jammers 1422*a-b* may include the intelligent jammer 222 shown in FIG. 2.

The intelligent jammers 1422*a-b* communicate with the IDJS 1424 using a network 1412. The network 1412 may include on or more of wired, wireless, and optical data communication links. Wired data communication links include Ethernet, USB, IEEE-488, PCI, PCI Express, Controller Area Network (CAN), Inter-Integrated Circuit ($I^2C$), Serial Peripheral Interface (SPI), and RS-485. Wireless data communication links include Wi-Fi, WiMax, cellular, microwave, satellite data communication links. Optical data communication links include fiber-optic and free-space optical data communication links. In an embodiment, the network 1412 includes a portion of the Internet.

In an embodiment, one or more of the IDJS 1424 and the intelligent jammers 1422*a-b* include a USIM or emulated USIM that that permits the use of the wireless communication services provided by or accessed through the unlicensed eNodeB 1430. For example, the second intelligent jammer 1422*b* may impersonate the UE 1434 in order to communicate with the IDJS 1424 through the unlicensed eNodeB 1434, while also jamming communications between the unlicensed eNodeB and the UE 1434. In such an embodiment, the network 1412 includes the unlicensed eNodeB 1430.

The IJDS 1424 and the intelligent jammers 1422*a-b* together with the communication resources provided to them by the network 1412 form the intelligent jamming system. 1402. The intelligent jamming system 1402 performs one or more of the processes 700, 800 and 900 shown in FIGS. 7-9, respectively, described above. Accordingly, the intelligent jamming system 1402 detects, identifies, and degrades or disables the operation of the unlicensed eNodeB 1430.

The teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source; and transmitting a jamming signal according to the time and the frequency of the protocol signal, wherein determining that the signal source is the unlicensed signal source comprises:

determining a characteristic of a received signal from the signal source, the characteristic including one or more of a location, a frequency, or an identifier;

determining whether the characteristic of the received signal is in a predetermined database; and when the characteristic of the received signal is not in the database, classifying the signal source as the unlicensed signal source.

2. The method of claim 1, wherein determining that the signal source is the unlicensed signal source further comprises:

when the characteristic of the received signal is in the database and the characteristic is not associated with a licensed signal source, classifying the signal source as the unlicensed signal source.

3. The method of claim 1, wherein the characteristic includes a channel center frequency or a channel bandwidth.

4. The method of claim 1, wherein the identifier includes a Public Land Mobile Network ID (PLMN ID), a Mobile Country Code (MCC), a Mobile Network Code (MNC), a Tracking Area Code (TAC), or an E-UTRAN Cell Global ID (ECGI).

5. The method of claim 1, wherein transmitting the jamming signal comprises:

detecting a change in the time or the frequency of the protocol signal; and transmitting the jamming signal according to the change in the time or the frequency of the protocol signal.

6. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source; and transmitting a jamming signal according to the time and the frequency of the protocol signal, wherein determining that the signal source is the unlicensed signal source comprises:

receiving a signal from the signal source; and performing an authentication protocol with the unlicensed signal source, wherein the authentication protocol fails.

7. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source; and transmitting a jamming signal according to the time and the frequency of the protocol signal, wherein the unlicensed signal source is a cellular radio base station, and wherein transmitting the jamming signal comprises transmitting an uplink (UL) jamming signal, the UL jamming signal including one or more of a Physical Random Access Channel (PRACH) noise signal, a bogus PRACH preamble signal, or an edge noise signal.

8. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source; and transmitting a jamming signal according to the time and the frequency of the protocol signal, wherein the unlicensed signal source is a cellular radio base station, and wherein transmitting the jamming signal comprises transmitting a downlink (DL) jamming signal, the DL jamming signal including one or more of a downlink channel center (DLCC) noise signal, a bogus Primary Synchronization Signal (PSS), a bogus Secondary Synchronization Signal (SSS), or a bogus Broadcast Channel (BCH) signal.

9. The method of claim 8, wherein transmitting the jamming signal comprises transmitting the bogus PSS or the bogus SSS in a subframe of an LTE frame other than a first subframe and a sixth subframe, transmitting the bogus BCH signal in a subframe of the LTE frame other than a first subframe, or a combination thereof.

10. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source;

transmitting a jamming signal according to the time and the frequency of the protocol signal; and determining a time and a frequency of an expected transmission to or from the unlicensed signal source, wherein transmitting the jamming signal comprises transmitting the jamming signal at a time and a frequency corresponding to the time and a frequency of the expected transmission to or from the unlicensed signal source.

11. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source; and transmitting a jamming signal according to the time and the frequency of the protocol signal wherein transmitting the jamming signal according to the time and frequency of the protocol signal comprises:

selecting the intelligent jammer from a plurality of intelligent jammers according to an RF path loss associated with the intelligent jammer; and transmitting the jamming signal using the intelligent jammer.

12. A method for detecting and jamming a wireless network using an intelligent jammer, the method comprising:

determining that a signal source is an unlicensed signal source;

synchronizing the intelligent jammer with the unlicensed signal source;

determining a time and a frequency of a protocol signal associated with the unlicensed signal source; and transmitting a jamming signal according to the time and the frequency of the protocol signal, wherein the intelligent jammer is a first intelligent jammer, and transmitting the jamming signal comprises:

selecting the first intelligent jammer from a plurality of intelligent jammers;

selecting a second intelligent jammer from the plurality of intelligent jammers;

transmitting a downlink (DL) jamming signal using the first intelligent jammer; and transmitting an uplink (UL) jamming signal using the second intelligent jammer.

13. A system for detecting and jamming a wireless network, the system comprising:

a first intelligent jammer; and an Intelligent Detection and Jamming Server (IDJS) coupled to the first intelligent jammer, the IDJS including a processor and a non-transitory computer readable medium with computer executable instructions stored thereon which, when executed by the processor, perform the following steps:

receiving first information associated with a signal source from the first intelligent jammer;

determining that a signal source is an unlicensed signal source using the first information; and transmitting a first instruction to jam the unlicensed signal source to the first intelligent jammer, wherein the first instruction includes an instruction to periodically vary a frequency of a jamming signal, a timing of a jamming signal, symbols of a jamming signal, or a combination thereof.

14. The system of claim 13, wherein the first instruction includes an instruction to jam one or more protocol signals associated with the unlicensed signal source.

15. A system for detecting and jamming a wireless network, the system comprising:

a wireless device;

a first intelligent jammer; and an Intelligent Detection and Jamming Server (IDJS) coupled to the first intelligent jammer, the IDJS including a processor and a non-transitory computer readable medium with computer executable instructions stored thereon which, when executed by the processor, perform the following steps:

receiving first information associated with a signal source from the first intelligent jammer;

determining that a signal source is an unlicensed signal source using the first information; and transmitting a first instruction to jam the unlicensed signal source to the first intelligent jammer, wherein the steps performed further include receiving second information associated with the signal source from the wireless device, and wherein determining that a signal source is an unlicensed signal source uses the first information and the second information.

16. A system for detecting and jamming a wireless network, the system comprising:

a wireless device;

a first intelligent jammer;

a second intelligent jammer; and an Intelligent Detection and Jamming Server (IDJS) coupled to the first intelligent jammer, the IDJS including a processor and a non-transitory computer readable medium with computer executable instructions stored thereon which, when executed by the processor, perform the following steps:

receiving first information associated with a signal source from the first intelligent jammer;

determining that a signal source is an unlicensed signal source usine the first information; and transmitting a first instruction to jam the unlicensed signal source to the first intelligent jammer, wherein the steps performed further include transmitting a second instruction to jam the unlicensed signal source to the second intelligent jammer, and wherein one of the first and second instructions includes an instruction to jam only an uplink channel, and the other of the first and second instructions includes an instruction to jam only a downlink channel.

17. A system for detecting and jamming a wireless network, the system comprising:

a wireless device;

a first intelligent jammer;

a second intelligent jammer; and an Intelligent Detection and Jamming Server (IDJS) coupled to the first intelligent jammer, the IDJS including a processor and a non-transitory computer readable medium with computer executable instructions stored thereon which, when executed by the processor, perform the following steps:

receiving first information associated with a signal source from the first intelligent jammer;

determining that a signal source is an unlicensed signal source using the first information; and transmitting a first instruction to jam the unlicensed signal source to the first intelligent jammer, wherein the steps performed further include transmitting a second instruction to jam the unlicensed signal source to the second intelligent jammer, and wherein the first instruction includes an instruction to transmit a jamming signal only at a time and a frequency when a communication to or from the unlicensed signal source is expected to occur.

18. A system for detecting and jamming a wireless network, the system comprising:

an Intelligent Detection and Jamming Server (IDJS); and an intelligent jammer coupled to the IDJS, the intelligent jammer including a transmitter, a receiver, a processor and a non-transitory computer readable medium with computer executable instructions stored thereon which, when executed by the processor perform the following steps:

receiving a signal from a signal source;

determining information associated with the signal source using the signal;

transmitting the information associated with the signal source; and receiving an instruction, wherein when the instruction includes an instruction to jam the signal source, generating and transmitting a jamming signal using the information associated with the signal source and information included in the instruction, wherein performing the steps further includes generating and transmitting the jamming signal only jamming an uplink channel, or generating and transmitting the jamming signal only jamming an downlink channel.

19. A system for detecting and jamming a wireless network, the system comprising:

an Intelligent Detection and Jamming Server (IDJS); and an intelligent jammer coupled to the IDJS, the intelligent jammer including a transmitter, a receiver, a processor and a non-transitory computer readable medium with computer executable instructions stored thereon which, when executed by the processor, perform the following steps:

receiving a signal from a signal source;

determining information associated with the signal source using the signal;

transmitting the information associated with the signal source; and receiving an instruction, wherein when the instruction includes an instruction to jam the signal source, generating and transmitting a jamming signal using the information associated with the signal source and information included in the instruction, wherein performing the steps further includes generating and transmitting the jamming signal only at a time and a frequency when a communication to or from the unlicensed signal source is expected to occur.

20. A system for detecting and jamming a wireless network, the system comprising:

an Intelligent Detection and Jamming Server (IDJS); and an intelligent jammer coupled to the IDJS, the intelligent jammer including a transmitter, a receiver, a processor and a non-transitory computer readable medium with computer executable instructions stored thereon which, when executed by the processor, perform the following steps:

receiving a signal from a signal source;

determining information associated with the signal source using the signal;

transmitting the information associated with the signal source; and receiving an instruction, wherein when the instruction includes an instruction to jam the signal source, generating and transmitting a jamming signal using the information associated with the signal source and information included in the instruction, wherein performing the steps further includes periodically varying a frequency of the jamming signal, a timing of the jamming signal, a symbol of the jamming signal, or a combination thereof.

* * * * *